US006262525B1

(12) United States Patent
Yamamoto et al.

(10) Patent No.: US 6,262,525 B1
(45) Date of Patent: Jul. 17, 2001

(54) COLOR CATHODE RAY TUBE HAVING A CONVERGENCE DEVICE CAPABLE OF CORRECTION OF CONVERGENCE WITHOUT LANDING TRANSITION OR RASTER ROTATION

(75) Inventors: Naoki Yamamoto; Yoshiaki Yanai; Kosuke Miyake, all of Shiga (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/400,842

(22) Filed: Sep. 21, 1999

(30) Foreign Application Priority Data

Sep. 24, 1998 (JP) ..... 10-269745

(51) Int. Cl.[7] ..... H01J 29/54
(52) U.S. Cl. ..... 313/440; 335/213; 335/299
(58) Field of Search ..... 313/440, 441, 313/426, 413, 431; 335/210, 213–296, 299; 348/831

(56) References Cited

U.S. PATENT DOCUMENTS 4,786,838 * 11/1988 Meershoek et al. ..... 313/440
5,019,745 * 5/1991 Deal et al. ..... 313/440
5,952,905 * 9/1999 Kim et al. ..... 313/440 X

FOREIGN PATENT DOCUMENTS

2235575 * 3/1991 (GB) ..... 313/440
8-185812 7/1996 (JP) .

* cited by examiner

*Primary Examiner*—Ashok Patel
(74) *Attorney, Agent, or Firm*—Young & Thompson

(57) ABSTRACT

A ring-formed correction coil for generating a magnetic field is mounted on the cathode side of CPM 4 provided on the neck portion of a color cathode ray tube, thereby being disposed distant from the deflection yoke. By using the magnetic field generated by supplying a correction current from a control circuit to the correction coil of this arrangement, correction of convergence error of R and G beam horizontal lines are carried out without causing landing transition or raster rotation. Further, since the correction coil is disposed distant from the phosphor screen, a large amount of correction can be assured on the phosphor screen, thereby saving current supplied from the control circuit to the correction coil.

3 Claims, 3 Drawing Sheets

COLOR CATHODE RAY TUBE HAVING A CONVERGENCE DEVICE CAPABLE OF CORRECTION OF CONVERGENCE WITHOUT LANDING TRANSITION OR RASTER ROTATION

BACKGROUND OF THE INVENTION

1. Field of the Invention

The present invention relates to a color cathode ray tube, and more particularly to a color cathode ray tube provided with a convergence device regulated to prevent convergence error caused by an external magnetic field or the like.

2. Description of the Related Art

In recent years, there has been a growing demand on the market for a color cathode ray tube which allows a user himself to correct convergence error after the color cathode ray tube is shipped, caused by an external magnetic field under working conditions.

Heretofore, correction coils mounted on the rear end of a deflection yoke disposed in front of a CPM (Convergence Purity Magnet) have been used as the major means for correcting convergence slipping of horizontal lines.

In this regard, a color cathode ray tube with a convergence device of the structure shown in FIG. 1 has been disclosed in Japanese Patent Laid-open Publication No. 185812/96.

Color cathode ray tube unit 101 has convergence device 106 comprising deflection yoke 103 mounted on neck portion 102, correction coil 105 wound between CPM 104, and control circuit 107.

Neck portion 102 of a color cathode ray tube of this kind generally has the structure shown in FIG. 2. That is, in the inside of neck portion 102, there is provided the triode portion comprising cathode 117 for emitting electron beams R, G, B, heater 118 for heating cathode 117, G1 electrode 110, G2 electrode 111, and an MFL (Main Focus Lens) comprising a plurality of electrodes including G3 electrode 112 and G4 electrode 113. The position for adjusting the static convergence of electron beam 115 caused by the MFL is shown as MFL position 114. Further, on the outer circumference of neck portion 102, correction coil 105 is disposed in the vicinity of MFL position 114.

However, since a cathode ray tube unit of this structure is arranged so that it acts in the vicinity of the MFL to bend side beams R and B of the electron beams R, G, B, landing transition or raster rotation are caused concurrently with the convergence correction activity.

Landing transition and raster rotation are generated when a convergence correction current is supplied from control circuit 107 to correction coil 105 disposed between deflection yoke 103 and CPM 104 due to changes in orbits of electron beams caused by the magnetic field produced by correction coil 105 which affects the area up to near the deflection point of deflection yoke 103.

Further, the amount of correction of this color cathode ray tube unit applied to correct the convergence error caused by an external magnetic field is rather insufficient. In order to meet the necessary and sufficient amount of correction, there have been no means other than augmenting the number of turns of correction coil 105 or increasing the control current supplied from control circuit 107, both violating the policy for saving power. In other words, when the distance between correction coil 105 and phosphor screen 116 is short, it is required to augment the magnetic force of the correction coil to the side beam for correcting convergence error on phosphor screen 116, and consequently power supply from control circuit 107 to correction coil 105 is inevitably increased.

SUMMARY OF THE INVENTION

An object of the present invention is to provide a color cathode ray tube having a convergence device for correcting convergence error without causing landing transition or raster rotation.

Another object of the present invention is to provide a color cathode ray tube having a convergence device which is capable of performing highly sensitive correction of convergence with a reduced dissipation current.

For achieving the above purpose, the color cathode ray tube of the present invention includes a convergence device comprising a correction coil disposed between a cathode and a CPM (Convergence Purity Magnet), and a control circuit which supplies an electric current to the correction coil.

In the color cathode ray tube of the present invention, the correction coil is provided distant from a deflection yoke because the correction coil is disposed between the cathode and the CPM. Therefore, since the influence that the magnetic field generated by the correction coil due to the current from the control circuit exerts on the deflection yoke is reduced, the convergence error can be corrected without causing landing transition or raster rotation.

According to an embodiment of the present invention, the 4-pole magnet of the convergence purity magnet serves as a means for bending the side beams of the electron beams in the direction of the tube axis of the neck portion at the cathode side of the main focus lens.

Further, according to this embodiment of the present invention, the main focus lens, axis of which corresponds to axis of side beams of the electron beam in the triode portion comprising the cathode, G1 electrode and G2 electrode and inclined toward the tube axis of the neck portion, serves as a means for bending side beams of the electron beam toward the tube axis at the position on the cathode side of the main focus lens.

In additions, since the color cathode ray tube of the present invention disposes a correction coil away from a deflection yoke, landing characteristics and strain characteristics do not change even if a current flows in the correction coil. Also since the electron beams are corrected by means of the correction coil at a position distant from the phosphor screen, a large amount of correction can be assured on the phosphor screen, thereby reducing the current which flows from the control circuit into the correction coil.

The above and other objects, features and advantages of the present invention will become apparent from the following description with reference to the accompanying drawings which illustrate examples of the present invention.

DETAILED DESCRIPTION OF THE PREFERRED EMBODIMENTS

Figure 3:
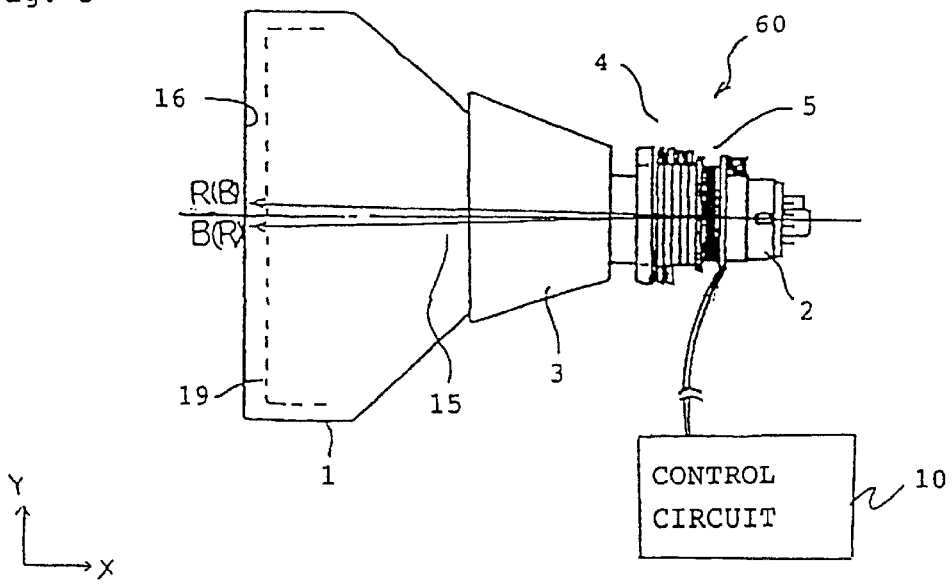
FIG. 3 is a schematic constitutional view of a color cathode ray tube of an embodiment of the present invention.

As shown in FIG. 3, color cathode ray tube 1 of an embodiment of the present invention has neck portion 2 incorporating an electron gun (refer to FIG. 5) for emitting electron beam 15 composed of beams R, G, B, and convergence device 60 which comprises CPM 4 for regulating purity and convergence, correction coil 5 for correcting the convergence of side beams R and B of electron beam 15, and control circuit 10 for supplying a current to correction coil 5. Further, color cathode ray tube 1 includes deflection yoke 3 for deflecting electron beam 15, shadow mask 19 and phosphor screen 16.

It is to be noted that in the following description, the vertical direction represents the Y direction shown in each figure, and the horizontal direction represents the X direction shown in each figure.

Figure 4:
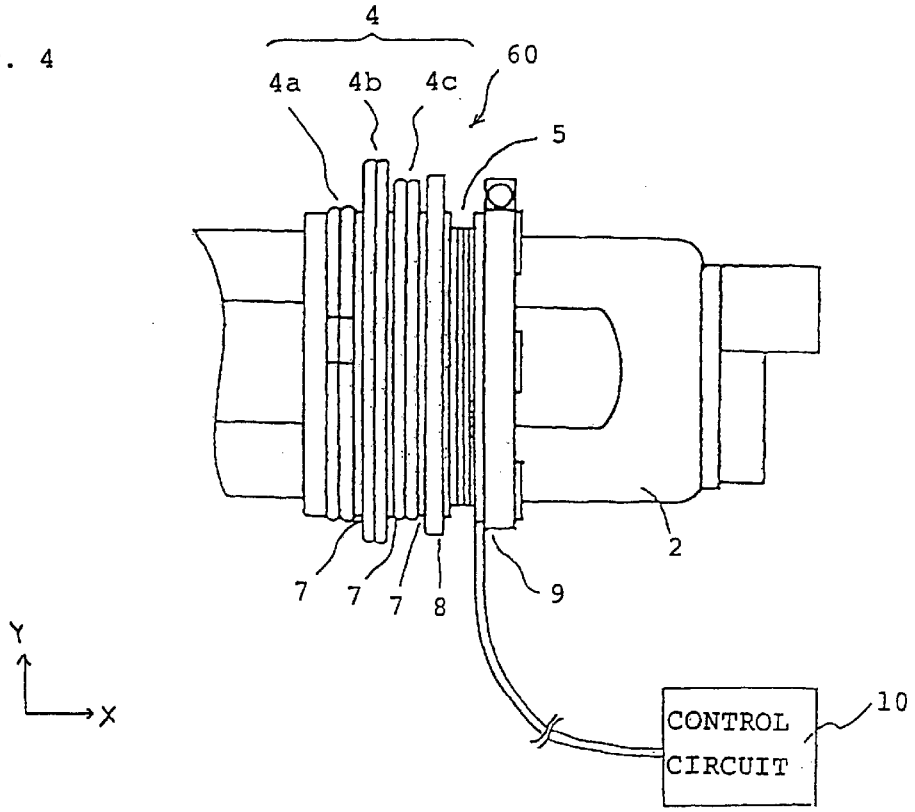
FIG. 4 is a constitutional view of a neck portion of the color cathode ray tube of FIG. 3 mounted with the convergence device.

As shown in FIG. 4, CPM 4 and correction coil 5 of convergence device 60 are attached on the outer circumference of neck portion 2. CPM 4 is constructed by arranging in a row, starting from phosphor screen 16 side, a pair of purity adjusting 2-pole magnets 4*a,* a pair of convergence adjusting 4-pole and 6-pole magnets 4*a,* 4*b,* and interposing spacer 7 therebetween. Correction coil 5 is shown in FIG. 3 on the right hand side of CPM 4, that is, on the cathode 17 (refer to FIG. 5) side, and CPM 4 and correction coil 5 are positioned being tightly fixed by lock ring 8. CPM 4 and correction coil 5 fastened by lock ring 8 as a unit are further secured by fasten band 9 for fixing them at a predetermined position of neck portion 2.

Figure 5:
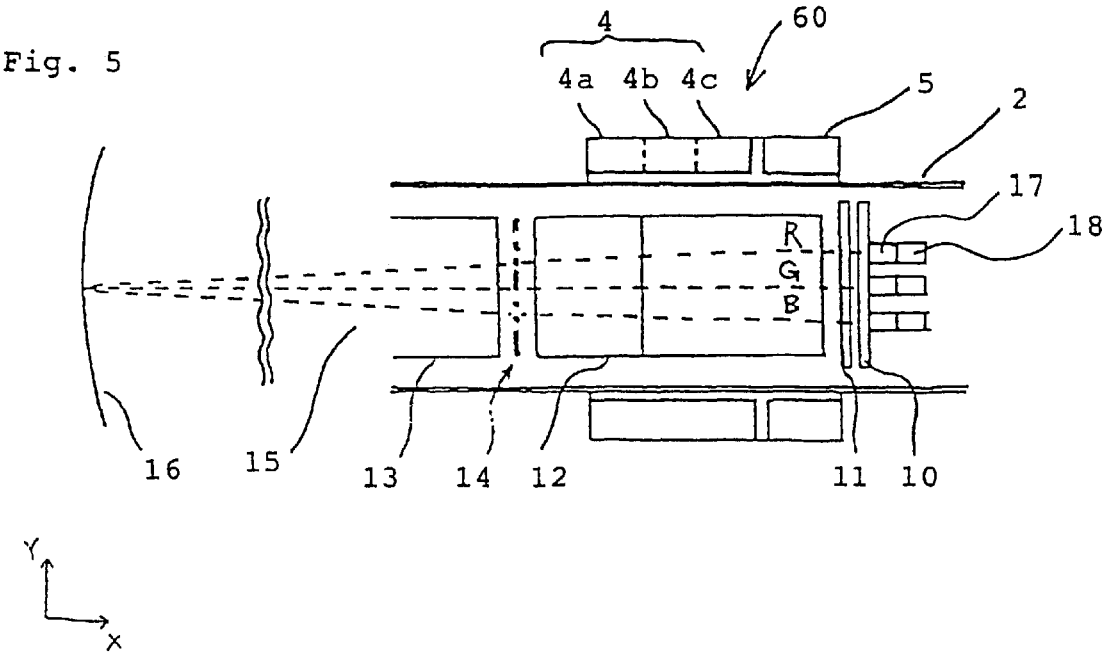
FIG. 5 is a view showing the positional relationship between the convergence device of the present invention mounted on the neck portion thereof and an MFL position of the electron gun.

As shown in FIG. 5, an electron gun provided inside neck portion 2 has the triode portion comprising cathode 17, heater 18, G1 electrode 10 and G2 electrode 11, and an MFL (Main Focus Lens) comprising a plurality of electrodes including G3 electrode 12 and G4 electrode 13. The position at which electron beam 15 is bent to adjust static convergence by this MFL is represented as MFL position 14.

The operation principle of color cathode ray tube 1 will next be described.

Electron beam 15 emitted from the cathode of the electron gun is corrected by CPM 4 for adjusting purity and the convergence. The deflected electron beam 15 passes through holes of shadow mask 19 to hit phosphor screen 16, whereupon irradiating three colors R, G, B.

Now, in the manufacturing process of color cathode ray tube 1, deflection yoke 3 is adjusted such that three colors R, G, B coincide with each other on phosphor screen 16 of color cathode ray tube 1. However, if phosphor screen 16 is oriented toward the south-north direction when used by a user, side beams R and B of electron beam 15 are affected by the geomagnetic field and convergence error is generated in the vertical direction on phosphor screen 16, as shown in FIG. 3.

Correction coil 5 produces a magnetic field from the correction current from control circuit 10, and according to this magnetic field, performs correction of convergence by vertically moving side beams R and B which are vertically shifted as described above.

Now, correction of convergence of side beams R and B to be performed by correction coil 5 will be described in detail.

Although correction coil 5 wound around neck portion 2 generates a magnetic field in the direction of the tube axis, it is unable to move electron beam 15 with only with this magnetic field in the direction perpendicular to the tube axis when the direction of electron beam is toward the tube axis from the cathode toward phosphor screen 16. However, in order to take the state of static convergence, the side beams R and B are slightly tilted in the direction of the tube axis. Therefore, the magnetic field perpendicular to the direction of the tube axis acts upon the velocity component perpendicular to the direction of the tube axis, thereby moving side beams R and B vertically.

Figure 1:
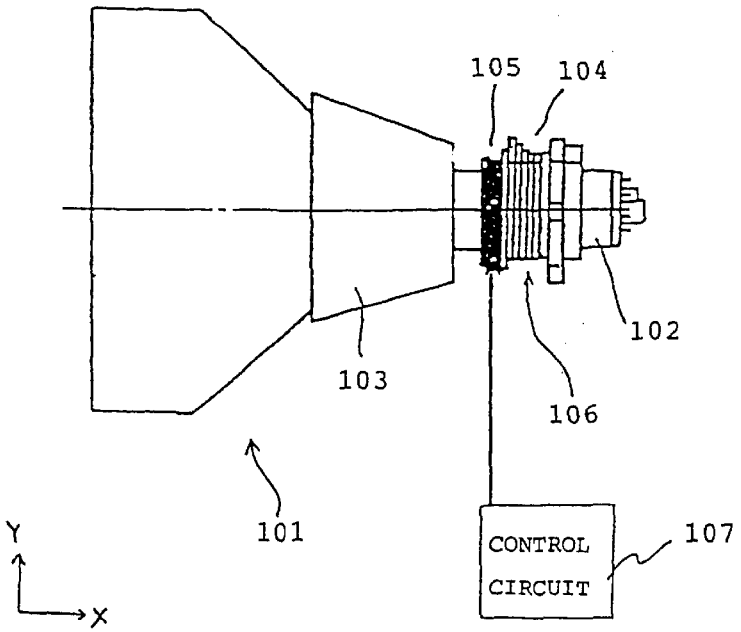
Fig. 1 (Prior Art)
FIG. 1 is a constitutional view showing a color cathode ray tube having a convergence device of the conventional type.
Figure 2:
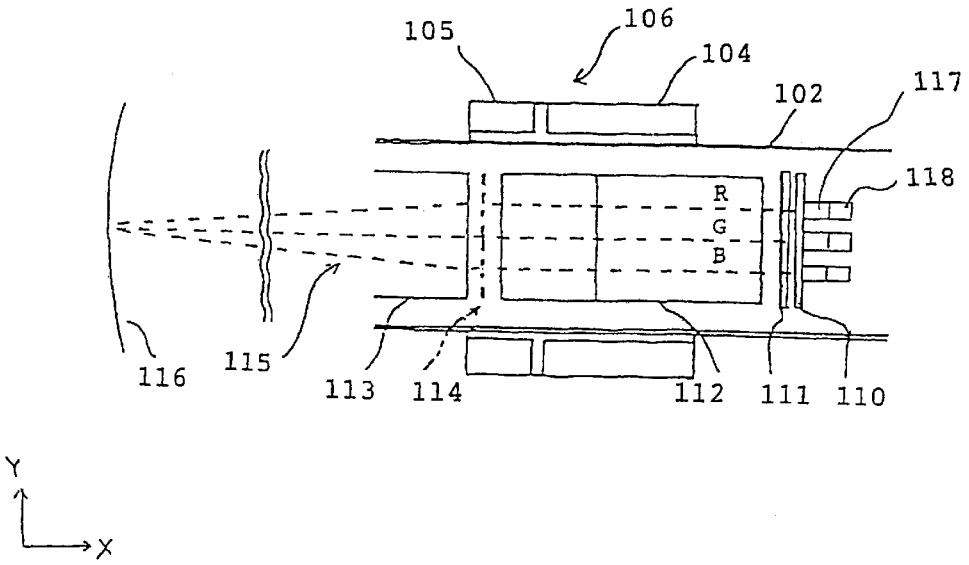
Fig. 2 (Prior Art)
FIG. 2 is a view showing the positional relationship between the convergence device of FIG. 1 and an MFL position of an electron gun.

With a conventional color cathode ray tube, as shown in FIG. 2, the state of static convergence is regulated by the MFL. Therefore, if the position generating the velocity component of electron beam 115 perpendicular to the direction of the tube axis, that is, MFL position 114 and the position of the correction coil 105 is close to each other, it is possible to bend the side beams R and B in the direction perpendicular to the tube axis. However, when correction coil 5 is disposed away from MFL position 14 (on the side of the cathode) as the present embodiment, there are some cases in which electron beams R and B are not bent.

Accordingly, in this embodiment a structure is adopted in which the position for bending side beams R and B of electron beam 15 is set in the back to correspond to the position of correction coil 5, which is in back of CPM 4. In other words, the structure intends to generate the velocity component of side beams R and B of electron beam 15 toward the direction of the tube axis in the influence region of correction coil 5 disposed in the rear of MFL position 14.

As a concrete method for generating the velocity component toward the direction of the tube axis by bending the side beams R and B in the rear of MFL position 14, the present embodiment applies what is called (under OCV). This method intentionally makes the state of maladjusted static convergence by the MFL without CPM to generate the convergence error on phosphor screen 16, and as shown in FIG. 5, arranges so that static convergence may be realized by 4-pole magnet 4*b* of CPM 4. With this structure, electron beam 15 starts to bend in the vicinity of 4-pole magnet 4*b,* which results the velocity component being in the direction of the tube axis.

As another concrete method of bending the side beams R and B at the position in the rear of MFL position 14, there is a method which places the axis of the triode portion comprising the cathode, G1 electrode and G2 electrode, and the axis of the MFL in an eccentric relationship to each other. Specifically, by inclining side beams R and B toward the axis of the tube with respect to their respective paths in the triode portion in the electron gun, side beams R and B of electron beam 15 can be bent in the vicinity of G3 electrode 12, thereby making it possible to generate the velocity components toward the axis of the tube.

As described above, correction coil 5 of the present embodiment has CPM 4 disposed between deflection yoke 3 and correction coil 5, and hence it is considered to be disposed at a position distant from deflection yoke 3. Accordingly, the magnetic field generated by correction coil 5 can hardly influence deflection yoke 3, and hence no landing transition and raster rotation are produced.

Furthermore, since the embodiment of the present invention bends the side beams before they reach MFL position 14, landing characteristics and strain characteristics do not change even when a current is supplied to the correction coil 5, and also since electron beam 15 is corrected by correction coil 5 at a position distant from phosphor screen 16, a large amount of convergence correction can be assured on phosphor screen 16 even if the correction current supplied from control circuit 10 to correction coil 5 is small.

While preferred embodiments of the present invention have been described using specific terms, such description is for illustrative purposes only, and it is to be understood that changes and variations may be made without departing from the spirit or scope of the following claims.

What is claimed is:

1. A color cathode ray tube comprising:

an electron gun having a cathode for emitting electron beams and a main focus lens comprising a plurality of electrodes including a G3 electrode and a G4 electrode;

a deflection yoke for deflecting the direction of advance of said electron beams;

a convergence purity magnet comprising 2-pole, 4-pole and 6-pole electrodes disposed on the side closer to said cathode than said main focus lens;

a convergence device comprising a correction coil disposed between said cathode and said convergence purity magnet, and a control circuit for supplying a current to said correction coil;

a neck portion having said electron gun in the inside thereof and having said deflection yoke, said convergence purity magnet and said correction coil on the outer circumference thereof; and a phosphor screen for emitting light being irradiated by said electron beam.

2. A color cathode ray tube according to claim 1, wherein the 4-pole magnet of said convergence purity magnet serves as a means for bending the side beams of said electron beam in the direction of the tube axis of said neck portion at a position on the cathode side of said main focus lens.

3. A color cathode ray tube according to claim 1, wherein said main focus lens, the axis of which corresponds to the axis of the side beams in the triode portion comprising said cathode, G1 electrode and G2 electrode and inclined toward the tube axis of said neck portion, serves as a means for bending the side beams of said electron beams toward said tube axis at the position on said cathode side of said main focus lens.

* * * * *